US005129840A

United States Patent [19]

Kuzuno et al.

[11] Patent Number: 5,129,840

[45] Date of Patent: Jul. 14, 1992

[54] ELECTRICAL CONNECTOR

[75] Inventors: Katsutoshi Kuzuno; Shigeo Ishizuka; Masayuki Yamamoto, all of Shizuoka, Japan

[73] Assignee: Yazaki Corporation, Tokyo, Japan

[21] Appl. No.: 664,013

[22] Filed: Feb. 28, 1991

[30] Foreign Application Priority Data

Mar. 1, 1990 [JP] Japan ..... 2-47173

[51] Int. Cl.[5] ..... H01R 4/24

[52] U.S. Cl. ..... 439/397; 439/405

[58] Field of Search ..... 439/395–407, 439/417–419, 465

[56] References Cited

U.S. PATENT DOCUMENTS

| | | | |
|---|---|---|---|
| 4,350,404 | 9/1982 | Clark et al. | 439/399 |
| 4,875,875 | 10/1989 | Archer et al. | 439/465 |
| 4,932,892 | 6/1990 | Hatch | 439/417 |
| 4,975,078 | 12/1990 | Stroede et al. | 439/417 |

*Primary Examiner*—David L. Pirlot

*Attorney, Agent, or Firm*—Armstrong, Nikaido, Marmelstein, Kubovcik & Murray

[57] ABSTRACT

Long and short terminal lugs are installed in alternate slots formed in the connector housing. Each terminal lug consists of an electrical contact portion and a wire connecting portion connected together through an intermediate link portion. The wire connecting portion is larger in width than the electrical contact portion. The wire connecting portions of the long terminal lugs and those of the short terminal lugs are staggered from each other in the axial direction. The long terminal lugs each have a depressed intermediate link portion so that the wire connecting portions of the adjacent short terminal lugs positioned by the side of the depressed intermediate links of the long terminal lugs are given sufficient space and are not interfered with by the wire connecting portions of the adjacent long terminal lugs as in the conventional connectors. This construction allows reduction in the size of the connector housing.

6 Claims, 8 Drawing Sheets

ELECTRICAL CONNECTOR

BACKGROUND OF THE INVENTION

1. Field of the Invention

The present invention relates to an electrical connector used mainly for connecting wiring harnesses in automobiles.

2. Prior Art

In FIG. 12, a terminal lug a consists of a box-shaped electric contact portion $a_1$ and a wire connecting portion $a_2$ that, in combination with a wire piercing piece b, comes into pressure contact with a wire c. The width $l_2$ of the wire connecting portion $a_2$ is larger than the width $l_1$ of the electric contact portion $a_1$. This terminal lug a is installed in a terminal accommodating chamber $d_1$ in a connector housing d shown in FIG. 13. Since the pitch l between the terminal accommodating chambers $d_1$ is determined based on the width of the wire connecting portion $a_2$, the connector necessarily becomes large.

SUMMARY OF THE INVENTION

The present invention has been accomplished to overcome the above drawbacks and its objective is to provide a connector in which the pitch between the terminal accommodating chambers in the connector housing is determined on the basis of the smaller width $l_1$, thereby making the connector more compact.

To achieve the above objective, a connector of this invention comprises: a connector housing having a plurality of terminal accommodating chambers in which terminal lugs are installed; a plurality of short terminal lugs, each consisting of an electrical contact portion and a wire connecting portion connected together through an intermediate link portion, said wire connecting portion being larger in width than the electrical contact portion; a plurality of long terminal lugs, each consisting of an electrical contact portion and a wire connecting portion connected together through an intermediate link portion, said wire connecting portion being larger in width than the electrical contact portion; a terminal fixing member for fixing the terminal lugs; and a wire piercing piece support cover; whereby the short terminal lugs and the long terminal lugs are installed in alternate terminal accommodating chambers in the connector housing in such a way that the wire connecting portions of the short terminal lugs and those of the long terminal lugs are staggered from each other in the axial direction and that the wire connecting portions of the short terminal lugs and those of the long terminal lugs overlap each other in a transverse direction to a longitudinal axis of said connector.

PREFERRED EMBODIMENT OF THE INVENTION

Figure 1:
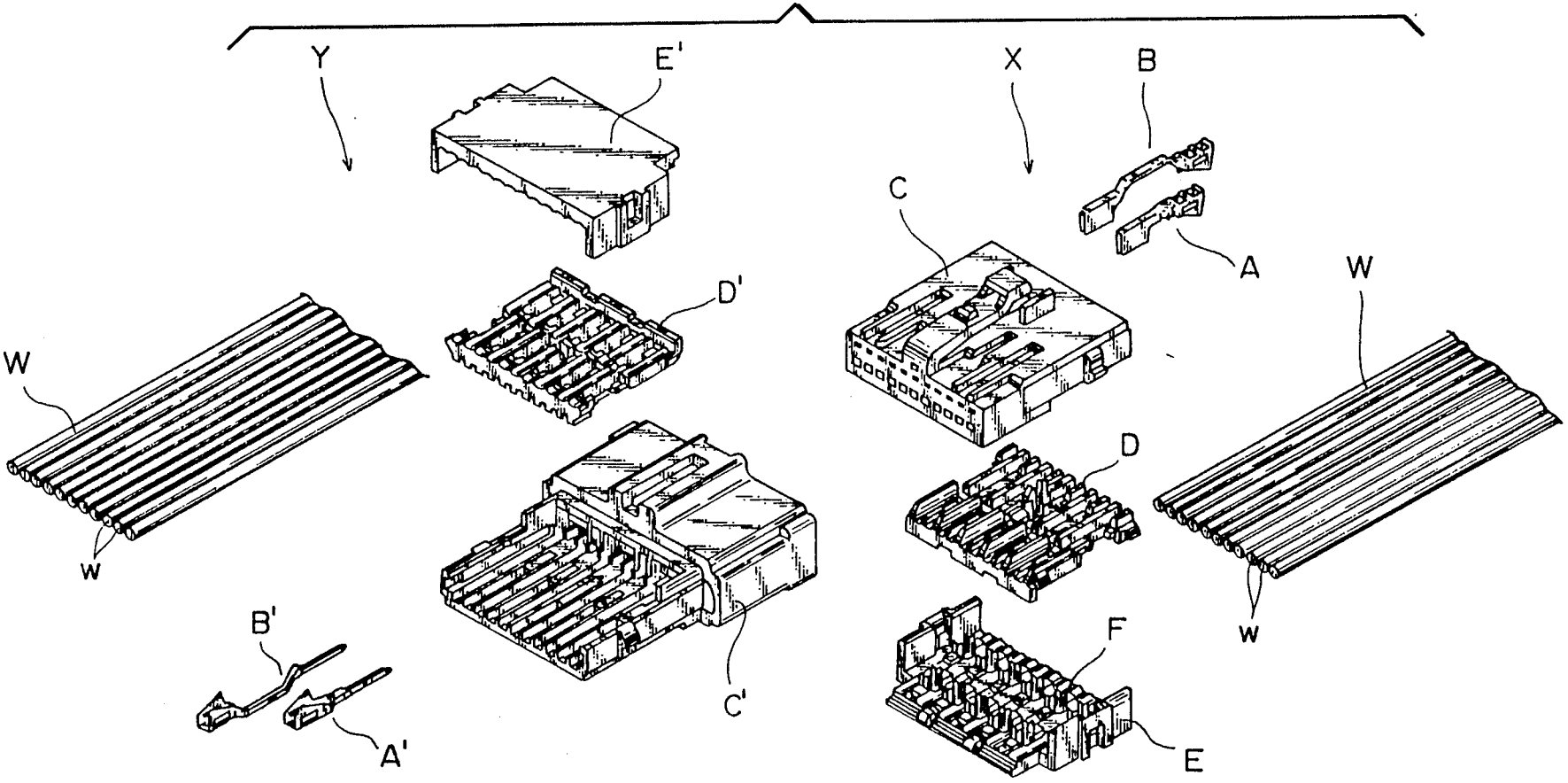
FIG. 1 is an exploded perspective view of one embodiment of this invention.

In FIG. 1, denoted A is a pressure contact type small female terminal lug for connection with a wire; B a pressure contact type large female terminal lug for connection with a wire; C a male connector housing made of synthetic resin; D a terminal fixing member made of synthetic resin; E a wire piercing piece support cover made of synthetic resin; F a wire piercing piece; and W a flat wiring harness having a number of parallelly arranged wires covered with continuous insulation. These components make up a male connector X. On the other hand, designated A' is a pressure contact type small male terminal lug for connection with a wire; B' a pressure contact type large male terminal lug for connection with a wire; C' a female type connector housing made of synthetic resin; D' a terminal fixing member made of synthetic resin; and E' a wire piercing piece support cover made of synthetic resin which supports the wire piercing piece F. These components along with the flat wiring harness form a female connector Y.

Figure 2A:
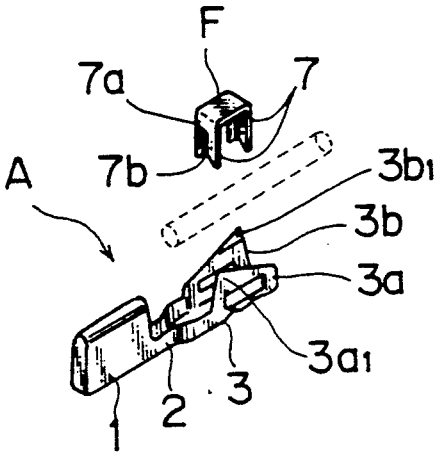
FIGS. 2*a* and 2*b* are perspective views of terminal lugs.
Figure 2B:
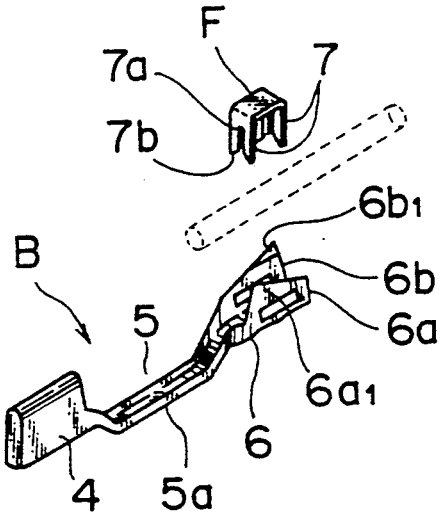
Figure 3C:
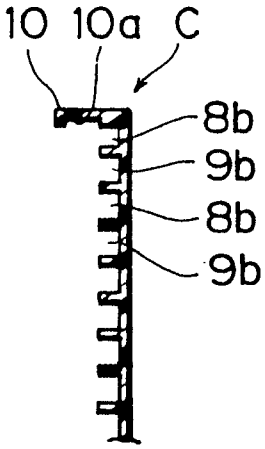
FIGS. 3*a*, 3*b* and 3*c* are a plan view of the connector housing, a cross section taken along the line III—III of FIG. 3*a*, and a cross section taken along the line III-'—III' of FIG. 3*a*.
Figure 3B:
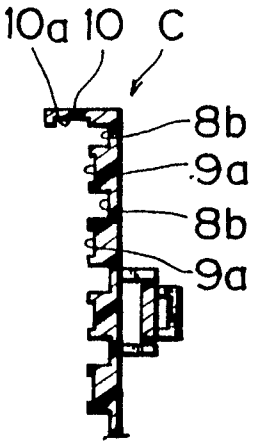
Figure 3A:
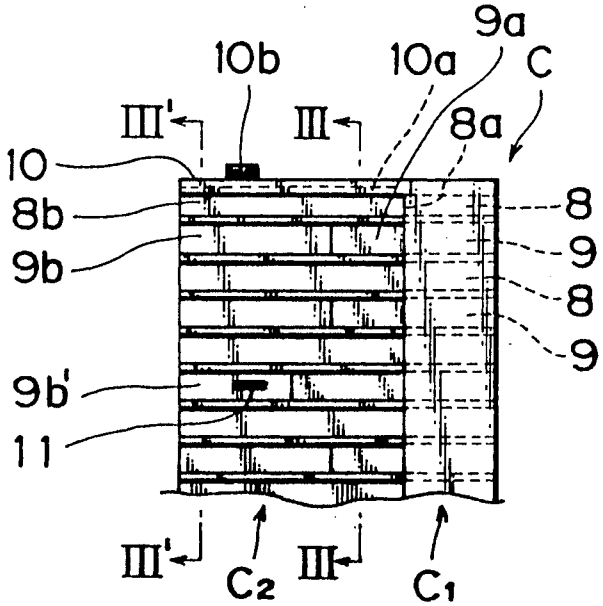
Figure 4:
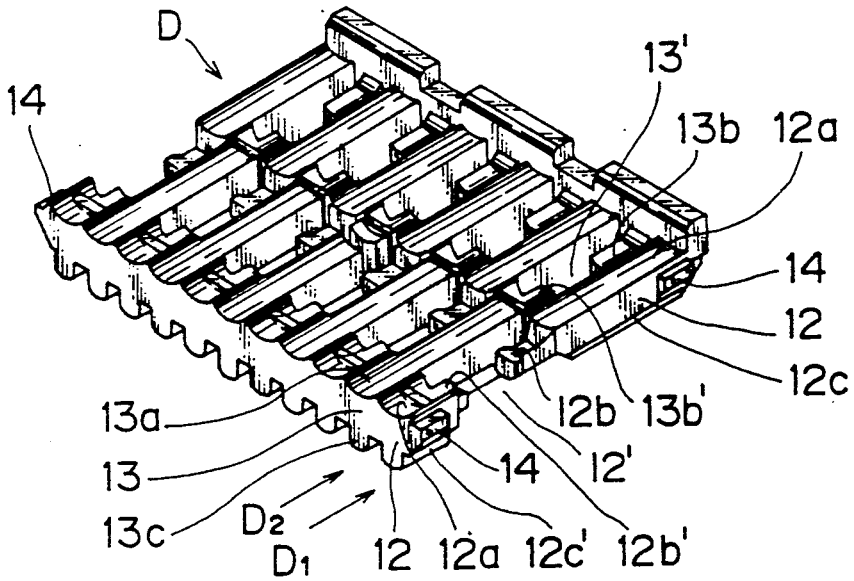
FIG. 4 is a perspective view of a terminal fixing member.
Figure 5:
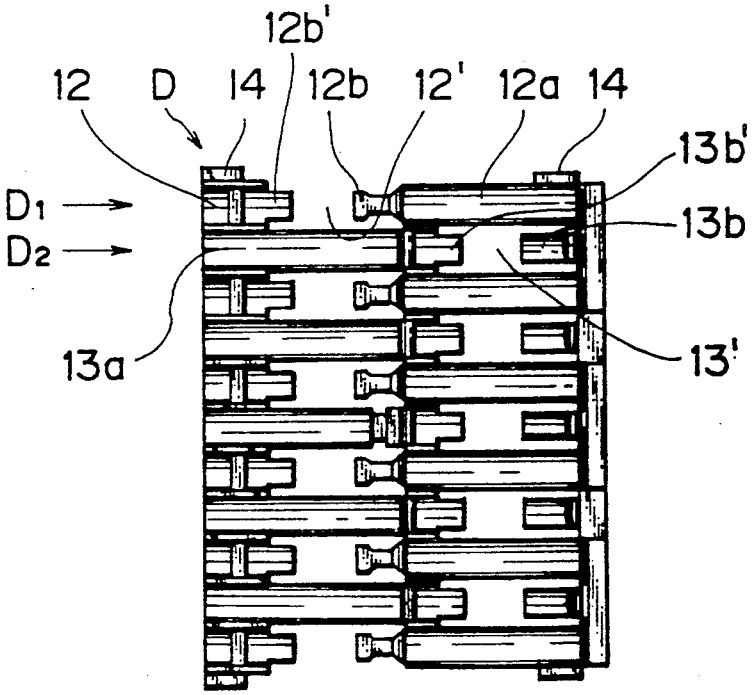
FIG. 5 is a plan view of the terminal fixing member.
Figure 6:
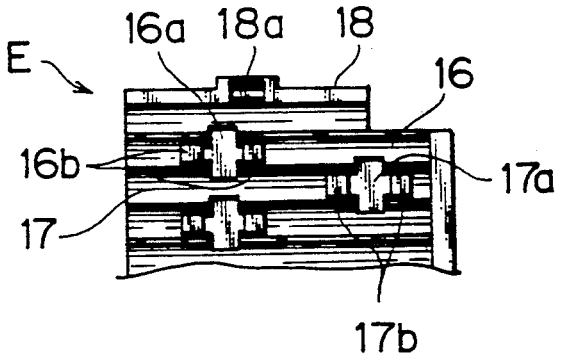
FIG. 6 is a plan view showing the interior of a cover.
Figure 7:
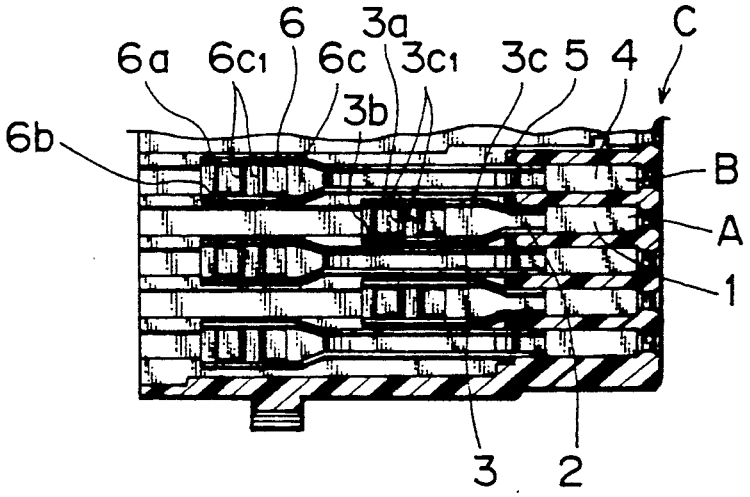
FIG. 7 is a partly cutaway plan view of the connector housing, showing the terminal lugs installed therein.
Figure 8:
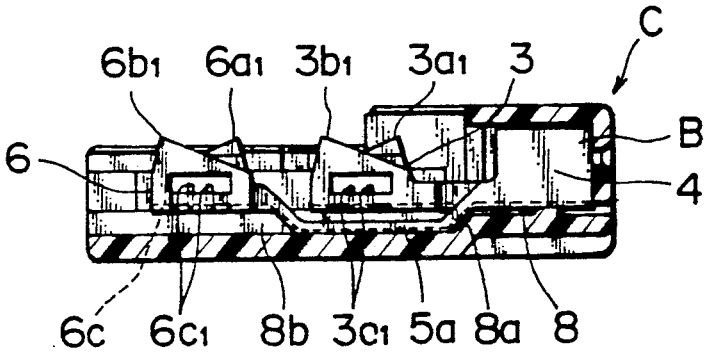
FIG. 8 is a side view of FIG. 7.
Figure 9:
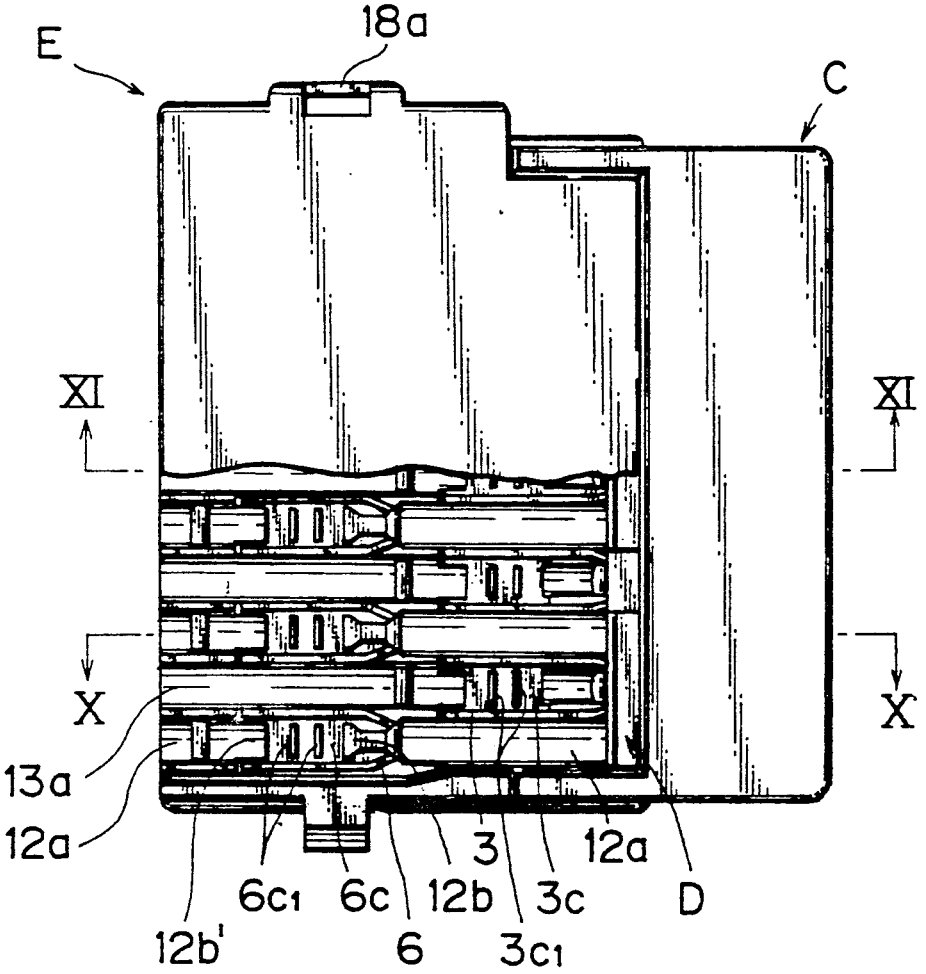
FIG. 9 is a partly cutaway plan view of a male connector.
Figure 10:
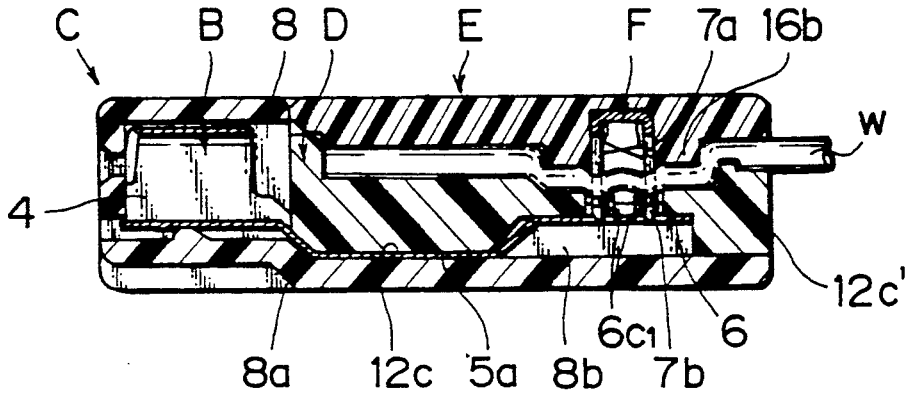
FIG. 10 is a cross section taken along the line X-X of FIG. 9.

As shown in FIGS. 2*a* and 2*b*, the pressure contact type small female terminal lug A has a narrow female electric contact portion I formed integral with a U-shaped intermediate link portion 2 of the same width, which in turn is formed integral with a wide U-shaped wire connecting portion 3. Opposing plate portions 3*a*, 3*b* of the U-shaped wire connecting portion 3 have pointed blades $3a_1$, $3b_1$ for cutting wire insulations. The U-shaped wire connecting portion 3 also has a pair of wire supporting pieces $3c_1$ cut and erected from a bottom plate portion 3*c*, as shown in FIGS. 7 and 8.

The pressure contact type large female terminal lug B has a narrow female electric contact portion 4 formed integral with a long U-shaped intermediate link portion 5, which in turn is formed integral with a wide U-shaped wire connecting portion 6. Opposing plate portions 6*a*, 6*b* of the U-shaped wire connecting portion 6 have pointed blades $6a_1$, $6b_1$ to cut wire insulations. The U-shaped wire connecting portion 6 has a pair of wire supporting pieces $6c_1$ cut and erected from a bottom plate portion 6*c*, as shown in FIGS. 7 and 8.

The long U-shaped intermediate link portion 5 has a depressed intermediate link portion 5*a*, which is at least equal in length to the wire connecting portion 3 of the small female terminal lug A so that the U-shaped intermediate link portion 5 does not run parallel to the wire connecting portion 3 at the same level.

The wire piercing piece F is roughly U-shaped and has a width such that it is received between the opposing plate portions 3*a*, 3*b*, 6*a*, 6*b*. The wire piercing piece F has a pair of opposing pieces 7, 7, each of which has a wire insulation cutting blade 7b with a groove 7a formed at the middle.

The male connector housing C is provided in its front-half case $C_1$ with terminal accommodating chambers 8 and 9 alternately, the terminal accommodating chambers 8 receiving the female electric contact portion 4 of the large female terminal lug B and the terminal accommodating chambers 9 receiving the female electric contact portion 1 of the small female terminal lug A. At an open portion $C_2$ of the rear-half, the male connector housing C has grooves 8b formed along the lines of extension of the terminal accommodating chambers 8, with inclined portions 8a connecting the terminal accommodating chambers 8 and the grooves 8b, as shown in FIG. 8. The open portion $C_2$ also has plateau portions 9a formed along the lines of extension of and at the same level of the terminal accommodating chambers 9 and has grooves 9b formed beyond the plateau portions 9a. Both side walls 10 of the open portion $C_2$ have engagement grooves 10a formed in the inner surface thereof. At a center groove 9b' is formed an engagement hole 11, into which a lock arm (described later) of the terminal fixing member D is fitted.

The terminal fixing member D as a whole is shaped like a frame and has large female terminal lug fixing portions $D_1$ and small female terminal lug fixing portions $D_2$ arranged alternately. The large female terminal lug fixing portion $D_1$ has support blocks 12 with an arc groove 12a at the front half and at the rear end and, between the support blocks 12, has a hollow portion 12' for wire pressure connection. In the hollow portion 12' there are provided a pair of terminal lug engagement pieces 12b, 12b'. The opposite side of the support block 12 is formed as engagement ribs 12c, 12c'.

The small female terminal lug fixing portion $D_2$ has a support block 13 with an arc groove 13a at the rear half and also a hollow portion 13' for wire pressure connection at the front half. In the hollow portion 13', there are a pair of terminal lug engagement pieces 13b, 13b'. The opposite side of the support block 13 is formed as an engagement rib 13c.

Figure 11:
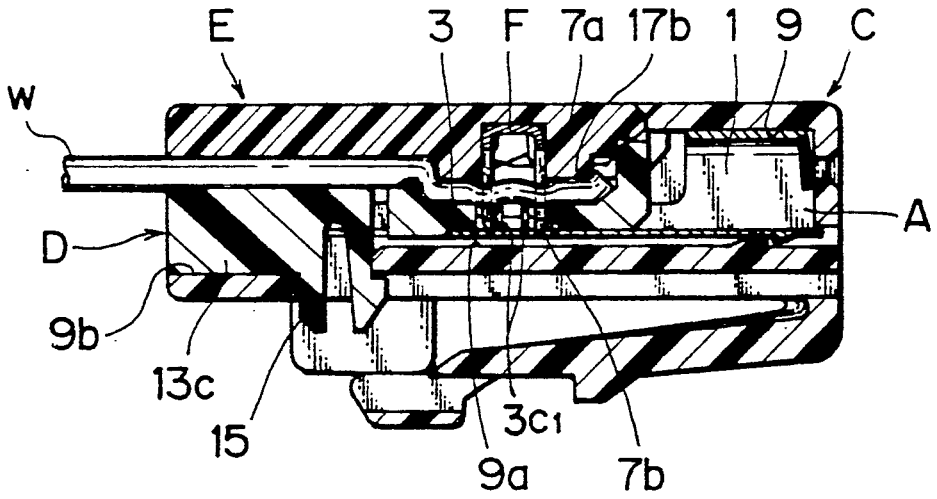
FIG. 11 is a cross section taken along the line XI—XI of FIG. 9.
Figure 12:
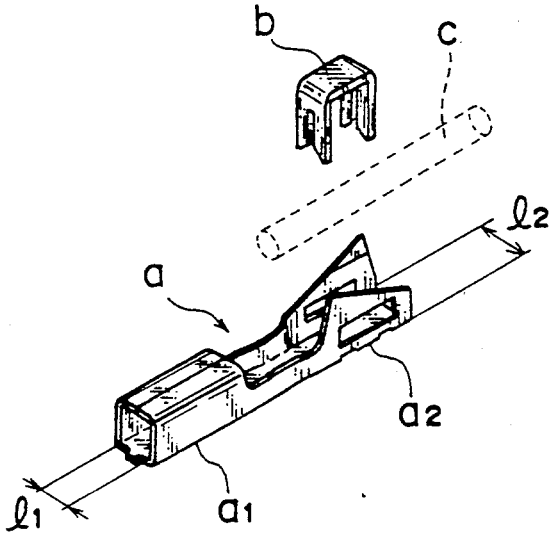
FIG. 12 PRIOR ART
FIG. 12 is a perspective view of a conventional terminal lug.
Figure 13:
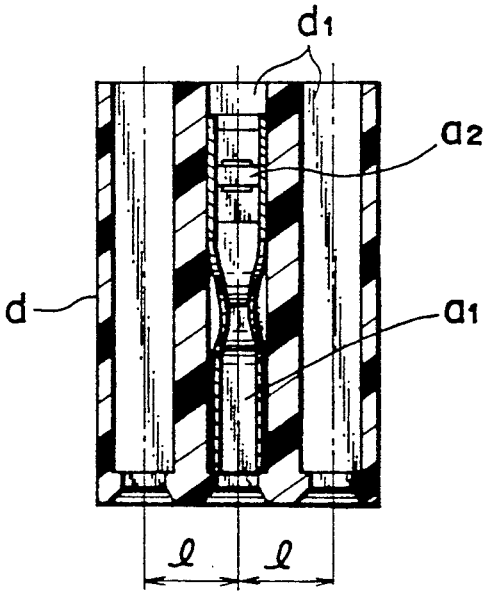
FIG. 13 PRIOR ART
FIG. 13 is a plan view showing the terminal lug of FIG. 12 installed in a connector housing which is cut away.

On both sides of the terminal fixing member D are provided engagement projections 14 for the connector housing C. At the center of the terminal fixing member D is formed a lock arm 15 that fits into the engagement hole II (see FIG. 11).

On the inner surface of the wire piercing piece support cover E are formed arc grooves 16, 17 at locations corresponding to the large female terminal lug fixing portions $D_1$ and the small female terminal lug fixing portions $D_2$. At the rear part of each arc groove 16 is formed a recess 16a to accommodate and securely hold the wire piercing piece F. At the front part of each arc groove 17 is formed a recess 17a to accommodate the wire piercing piece F. At the front and rear of each recess 16a, 17a are formed wire pressing projections 16b, 17b.

The wire piercing piece support cover E is provided on both sides with engagement plate portions 18, which are formed with engagement holes 18a for receiving the projections 10b on both sides of the connector housing.

Now, how this connector is assembled will be explained.

(1) The female electrical contact portion 4 of the large female terminal lug B is inserted into the terminal accommodating chamber 8 of the male connector housing C until the depressed intermediate link portion 5a of the long U-shaped intermediate link portion 5 is received in the groove 8b so that the U-shaped wire connecting portion 6 is located at the side walls of the groove 8b.

The female electric contact portion 1 of the small female terminal lug A is inserted into the terminal accommodating chamber 9 of the male connector housing C until the U-shaped wire connecting portion 3 is located on the plateau portion 9a.

(2) The terminal fixing member D is mounted on the open portion $C_2$ at the rear half of the male connector housing C. As a result, the lock arm 15 of the terminal fixing member D engages with the engagement hole 11 of the male connector housing C, and the engagement projections 14 on both sides of the terminal fixing member D engage with the grooves 10a on the inner surface of both side walls 10 of the male connector housing C.

In this condition, the front engagement rib 12c of the large female terminal lug fixing portion $D_1$ engages with the U-shaped depressed intermediate link portion 5a of the large female terminal lug B. At the same time, the rear engagement rib 12c' rests on the rear end of the groove 8b, and the pair of wire supporting pieces $6c_1$ erected at the bottom plate portion 6c of the U-shaped wire connecting portion 6 are received between the pair of terminal lug engagement pieces 12b, 12b' to securely position the U-shaped wire connecting portion 6 in the wire pressure connection hollow portion 12'.

The rear engagement rib 13c of the small female terminal lug fixing portion $D_2$ engages with the groove 9b, and the pair of terminal lug engagement pieces 13b, 13b' receive therebetween the pair of wire supporting pieces $3c_1$ to fix the U-shaped wire connecting portion 3 in the wire pressure connection hollow portion 13'.

(3) The flat wiring harness having a specified number of parallelly arranged wires w is set on the terminal fixing member D so that the wires w are each aligned with respective arc grooves 12a, 13a formed on the surface of the terminal fixing member D and that the wiring harness is positioned between the both side walls 10, 10 of the male connector housing C.

(4) The wire piercing piece support cover E is pressed against the open portion $C_2$ of the male connector housing C to engage the engagement plate portions 18 on both sides with the projections 10b of the connector housing C, thereby clamping together the support cover E and the connector housing C. At this time, the intermediate portions of insulation between the adjacent wires w of the wiring harness W is cut by pointed blades $3a_1$, $3b_1$, $6a_1$, $6b_1$ of the opposing plate portions 3a, 3b, 6a, 6b of the U-shaped wire connecting portions 3, 6, separating the wires w from each other. As a result, the wires w each advance into the respective U-shaped wire connecting portions 3, 6. Further, the cutting blades 7b of the wire piercing pieces F installed in the recesses in the wire piercing piece support cover E cut the insulation of the wires into the wire conductors making electrical contact with the wire conductors at the groove 7a. As the wire piercing piece support cover E is pressed against the open portion $C_2$, the wires w are bent and fixed by the wire pressing projections 16b, 16b and the wire supporting pieces $3c_1$, $6c_1$. The wire piercing pieces F further advance into the U-shaped wire connecting portions 3, 6 thus providing an electric path between the wire conductors and the U-shaped wire connecting portions 3, 6.

The female connector Y can be assembled in the same way.

The construction and advantage of the connector according to this invention may be summarized as follows. Each of long and short terminal lugs consists of an electric contact portion and a wire connecting portion of a width greater than that of the electric contact portion, these two portions being connected through an intermediate link portion. The long terminal lugs and the short terminal lugs are installed in the connector housing in such a way that the wire connecting portions of the long terminal lugs and those of the short terminal lugs are staggered from each other in the axial direction. The wire connecting portions of the long terminal lugs and those of the short terminal lugs partly overlap each other at their extensions. When terminal lugs are used which have a difference in width between the electrical contact portion and the wire connecting portion, the construction of this invention allows the connector size to be reduced without being restricted by the dimensions of the wider portion as in the conventional case.

What is claimed is:

1. An electrical connector comprising:

a connector housing having a plurality of adjacent laterally positioned terminal accommodating chambers in which terminal lugs are installed;

a plurality of short terminal lugs, each having an electrical contact portion and a wire connecting portion connected together through an intermediate link portion, said wire connecting portion being larger in width than the electrical contact portion; and a plurality of long terminal lugs, longer that said short terminal lugs, each having an electrical contact portion and a wire connecting portion connected together through an intermediate link portion, said wire connecting portion being larger in width than the electrical contact portion, said intermediate link portion of each long terminal lug being narrower in width than said wire connecting portion thereof;

the short terminal lugs and the long terminal lugs being installed with said electrical contact portions laterally aligned in terminal accommodating chambers in the connector housing, said wire connecting portion of each short terminal being laterally aligned with said intermediate link portion of each adjacent long terminal lug such that the wire connecting portions of the short terminal lugs and those of the long terminal lugs are staggered from each other in an axial direction and the wire connecting portions of the short terminal lugs and those of the long terminal lugs overlap each other when viewed axially through said connector housing accommodating chambers, whereby said connector housing is smaller in width than the sum of widths of said wire connecting portions of said plurality of long and short terminal lugs.

2. An electrical connector as claimed in claim 1, wherein said wire connecting portions each have opposing plates on each side thereof, said opposing plates being formed with pointed cutting blades at the top so that a plurality of wires, as they are pushed to the connector housing, are cut at intermediate portions of insulation between individual wires.

3. An electrical connector as claimed in claim 1, wherein said intermediate link portions of the long terminal lugs are depressed, the wire connecting portions of the short terminal lugs being positioned beside said depressed portions at different levels.

4. An electrical connector as claimed in claim 1 or 3, further comprising:

a terminal fixing member for fixing the terminal lugs; and a support cover for covering said terminal fixing member.

5. An electrical connector as claimed in claim 4, wherein an electrical connection between individual wires and associated terminal lugs are made through wire piercing pieces which are installed in recesses in the support cover.

6. An electrical connector as claimed in claim 5, wherein said wire piercing pieces have cutting blades which are each formed with a recess smaller in diameter than the wires and which cut insulation of the wires and are connected to the wire connecting portions of the terminal lugs when the support cover is clamped onto the connector housing.

* * * * *